United States Patent [19]

Prime

[11] 4,098,286

[45] Jul. 4, 1978

[54] HYDRAULIC CONTROL VALVE ASSEMBLY

[75] Inventor: Derek Arthur Prime, Uttoxeter, England

[73] Assignee: J.C. Bamford Excavators Limited, England

[21] Appl. No.: 751,075

[22] Filed: Dec. 16, 1976

[30] Foreign Application Priority Data

Dec. 19, 1975 [GB] United Kingdom ..... 52037/75

[51] Int. Cl.[2] ..... F15B 13/06

[52] U.S. Cl. ..... 137/270; 74/471 XY; 137/636.2

[58] Field of Search ..... 74/471 XY, 491, 522; 137/270, 636.2; 251/290

[56] References Cited

U.S. PATENT DOCUMENTS

| | | | |
|---|---|---|---|
| 3,492,889 | 2/1970 | Hauff | 74/491 X |
| 4,041,976 | 8/1977 | Brownell | 137/636.2 X |

*Primary Examiner*—Gerald A. Michalsky

*Attorney, Agent, or Firm*—Arnold, White & Durkee

[57] ABSTRACT

A hydraulic control valve assembly for use in an excavating vehicle to control the hydraulic motors which control the slew movement, boom, dipper and excavating bucket of the vehicle.

The assembly comprises two pairs of valves mounted in a base structure, each pair of valves being controlled by an operating lever mounted on a bracket. The bracket is connected to the base structure by a bolt and a universal joint and to the valve spools by links, the connections between the links and the bracket comprising universal joints.

The operating lever is moved in one direction to operate one of the valve spools and in another direction to operate the other valve spool. By slackening the bolt and rotating the bracket, the directions in which the operating lever is moved to operate the valve spools is also rotated.

8 Claims, 6 Drawing Figures

HYDRAULIC CONTROL VALVE ASSEMBLY

BACKGROUND OF THE INVENTION

The present invention relates to fluid control valve assemblies.

A fluid control valve assembly is sometimes provided in which a single operating lever operates two control valves which in turn control flow of fluid to fluid operated machines, movement of the operating lever in one direction operating one of the control valves and movement in another direction, usually at right angles to the first direction, controlling movement of the other valve.

With such a fluid valve control assembly, it is sometimes required to rotate the directions in which the operating lever has to be moved to operate the control valves without changing the position of the control valves.

For example, a hydraulic valve control assembly may be used in an excavating vehicle comprising a vehicle body mounted for slewing movement on the vehicle tracks and connected to a boom, the boom being connected to a dipper arm and the dipper arm carrying an excavating bucket. The excavating vehicle is provided with a first hydraulic machine to slew the body, a second hydraulic machine to raise and lower the boom, a third hydraulic machine to pivot the dipper arm relative to the boom and a fourth hydraulic machine to operate the bucket. It is usual in such an excavating vehicle for the hydraulic valves which control the first and second machine to be controlled by a single lever and for the hydraulic valves which control the third and fourth machine to be controlled by a second single lever.

In some countries it is required that movement of these levers in a first mode of operation i.e. in a forward and backward direction, relative to the normal position of the vehicle operator, controls one of the valves associated with each lever and movement in a left and right direction controls the other valve. In other countries it is required that movement in a second mode of operation i.e. in a first diagonal direction relative to the driver controls one of the valves and movement in a second diagonal direction controls the other valve.

As it is undesirable to have to provide vehicles having hydraulic control valve assemblies arranged in one configuration to meet the requirements of some countries and vehicles having hydraulic control valve assemblies arranged in a different configuration to meet the requirements of other countries, it is required to provide a hydraulic control valve assembly in which by means of a simple adjustment the mode of operation can be changed from meeting the requirements prevailing in some countries to meet the requirements prevailing in other countries.

SUMMARY OF THE INVENTION

It is accordingly an object of the present invention to provide a fluid control valve assembly which meets the above mentioned requirements.

According to the present invention there is provided a fluid control valve assembly comprising a control valve mounted in or on a base structure, the valve being provided with an operating member and movement of the operating member controlling the flow of fluid through the valve, an operating lever and a mechanism operatively connecting the operating lever to the operating member, the arrangement being such that movement of the operating lever in a particular direction operates the operating member and the said direction being rotatable with respect to the base structure.

Preferably the assembly comprises two valves mounted in or on the base structure, each of the valves being provided with an operating member and movement of each operating member controlling the flow of fluid through the associated valve, and the mechanism operatively connects the operating lever to both operating members, the arrangement being such that movement of the operating lever in one direction operates one of the operating members and movement in another direction operates the other operating member and the said directions being rotatable with respect to the base structure.

Preferably, the said mechanism comprises a bracket attached to the operating lever, the bracket being pivotally connected to the base structure at one position on the bracket, the pivotal connection between the bracket and the base structure permitting rotation of the bracket relative to the base structure about two axes and selectively permitting or preventing rotation about a third axis, and the bracket being connected to the one ends of two links at positions spaced apart from each other and also spaced apart from said one position, and the other ends of the two links being operatively connected to the operating members of the valves.

The connections between the bracket and the base structure and between the bracket and the links may comprise universal joints.

The connection between the bracket and the base structure may include a bolt, slackening or tightening the bolt permitting or preventing rotation about the third axis.

The line joining said one position with the position at which one of the links is connected to the bracket may form a right angle with a line joining said one position with a position at which the other of the links is connected to the bracket.

Preferably, the operating members comprise valve spools mounted for vertical sliding movement in their associated valves, the valves being positioned close together, and the bracket is positioned vertically above the valves.

The assembly may comprise a hydraulic control valve assembly.

Two hydraulic control valve assemblies as described in the preceding paragraphs may be provided on a single base structure and the two hydraulic valve control assemblies may be provided in an excavating vehicle.

When two hydraulic control valve assemblies are provided in an excavator, they may be used to control the hydraulic motors which control the slewing movement and the boom, dipper and excavating bucket.

BRIEF DESCRIPTION OF THE DRAWINGS

The present invention will now be described in more detail with reference to the accompanying drawings wherein.

DESCRIPTION OF THE PREFERRED EMBODIMENTS

Figure 1:
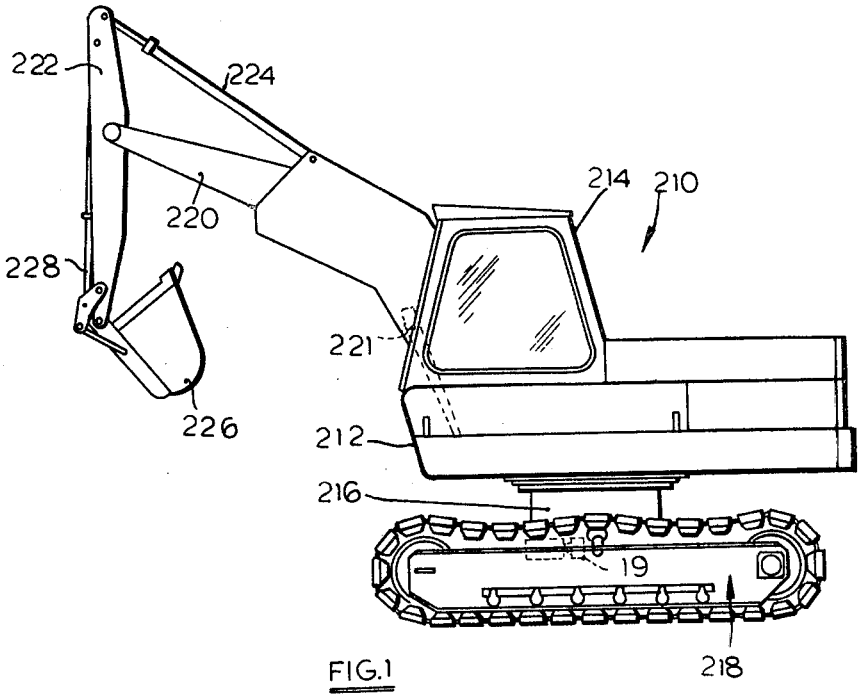
FIG. 1 is an elevational view of an excavator, embodying the invention.

Referring now to FIG. 1, there is shown an excavating vehicle 210 comprising a vehicle body 212 provided with a driver's cab 214 and mounted by means of a turntable member 216 for slewing movement on a pair of endless tracks 218. The vehicle body 212 is slewed with respect to the endless track 218 by means of a hydraulic slewing motor 19.

A boom member 220 is pivotally attached to the body 212 and may be raised and lowered by means of a pair of hydraulic boom motors 221. A dipper arm 222 is pivotally mounted on the boom 220 and may be pivoted with respect of the boom 220 by means of a hydraulic dipper motor 224. The dipper arm 222 can raise a bucket 226 for excavating and this bucket may be pivoted with respect to the dipper arm 222 by a hydraulic bucket motor 228.

Figure 2:
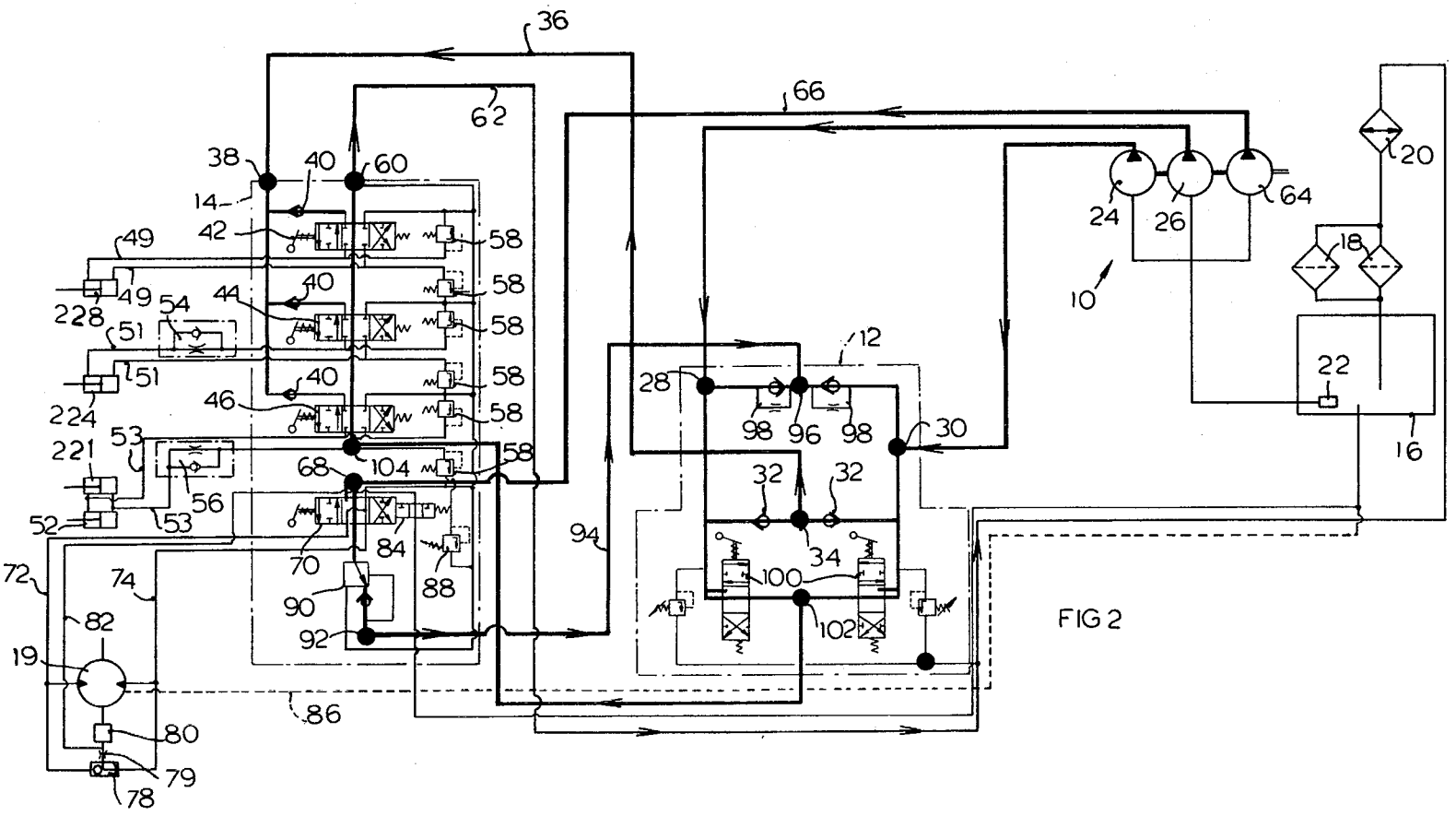
FIG. 2 is the circuit diagram of the hydraulic system which controls the slewing movement and the boom, dipper and excavating bucket of the excavator shown in FIG. 1.

Referring now to FIG. 2, there is shown a circuit diagram of the hydraulic system of the excavator shown in FIG. 1 and this system comprises a triple pump 10, which supplies hydraulic fluid to two hydraulic control valve assemblies indicated by chain dotted lines 12 and 14, and a tank 16 together with its associated filters 18 and oil cooler 20.

The triple pump 10 removes hydraulic fluid from the tank 16 through a strainer 22. Two of the pumps 24 and 26 supply hydraulic fluid to inlets 28 and 30 of the assembly 12. The fluid passes from the inlets 28 and 30 through one-way valves 32 to and outlet 34. From the outlet 34 the fluid passes through a line 36 to the main feed inlet 38 of the assembly 14.

The inlet 38 supplies hydraulic fluid through one-way valves 40 to control valves 42, 44 and 46 which supply hydraulic fluid to the bucket motor 228 through lines 49 to the dipper motor 224 through lines 51 and to the boom motor 221 through lines 53 respectively. The one-way valves 40 prevent reverse flow of fluid occurring, for example, if there is a pressure drop in the line 36. The lines 51 and 53 supplying fluid to the dipper motor 224 and the boom motors 221 are provided with one-way restrictors 54 and 56 which prevent these arms being lowered at an excessive rate. The lines 49, 51, 53 supplying fluid to the motors 228, 224 and 221 are also provided with relief valves 58.

The low pressure fluid from the valves 42, 44 and 46 passes to a main outlet 60 from where it passes along a line 62 to the oil cooler 20 and from there through filters 18 to return to the tank 16.

The third pump 64 of the triple pump 10, supplies fluid through a line 66 to a slew inlet 68 of the assembly 14. The slew inlet 68 supplies fluid to a valve 70 which supplies fluid through lines 72 and 74 to the slew motor 19. The line 72 and 74 also supplies fluid through a shuttle valve 78 and restrictor 79 to a brake 80. When the valve 70 is in its neutral position, the brake 80 is vented through a line 82 and an auxiliary valve 84 to the tank 16. The arrangement of the brake 80 is such that when it is supplied with fluid at a high pressure permits free rotation of the motor 19 and when it is vented to the tank 16 it exerts a braking force on the motor 19. Some of the fluid supplied to the motor 19 is also used for lubricating the moving parts of the motor and the fluid used for lubrication is returned to the tank 16 through a line 86. The lines 72 and 74 are also connected to a relief valve 88. The low pressure fluid from the valve 70 flows to the main outlet 60.

The valve 70 is also connected to an unloader 90 which in turn supplies fluid to a slew outlet 92. Fluid passes from the slew outlet 92 through a line 94 to an inlet 96 of the assembly 12 and from the inlet 96 through one way restrictor valves 98 to the inlets 28 and 30. Thus, when the valve 70 is not supplying fluid to the motor 76, fluid from the pump 64 can also be supplied to the inlet 38.

The inlets 28 and 30 also supply fluid to valves 100 which control the supply of fluid to the motors which operate the tracks of the excavater 10. The hydraulic circuit for supplying fluid to the track motors forms no part of the present invention and so will not be described.

Fluid flows from the valves 100 to an outlet 102 from the outlet 102 to a neutral circuit inlet 104 of the assembly 14. When none of the valves 42, 44 or 46 are supplying fluid to their respective motors, fluid may pass from the neutral circuit inlet 104 to the main outlet 60.

Figure 3:
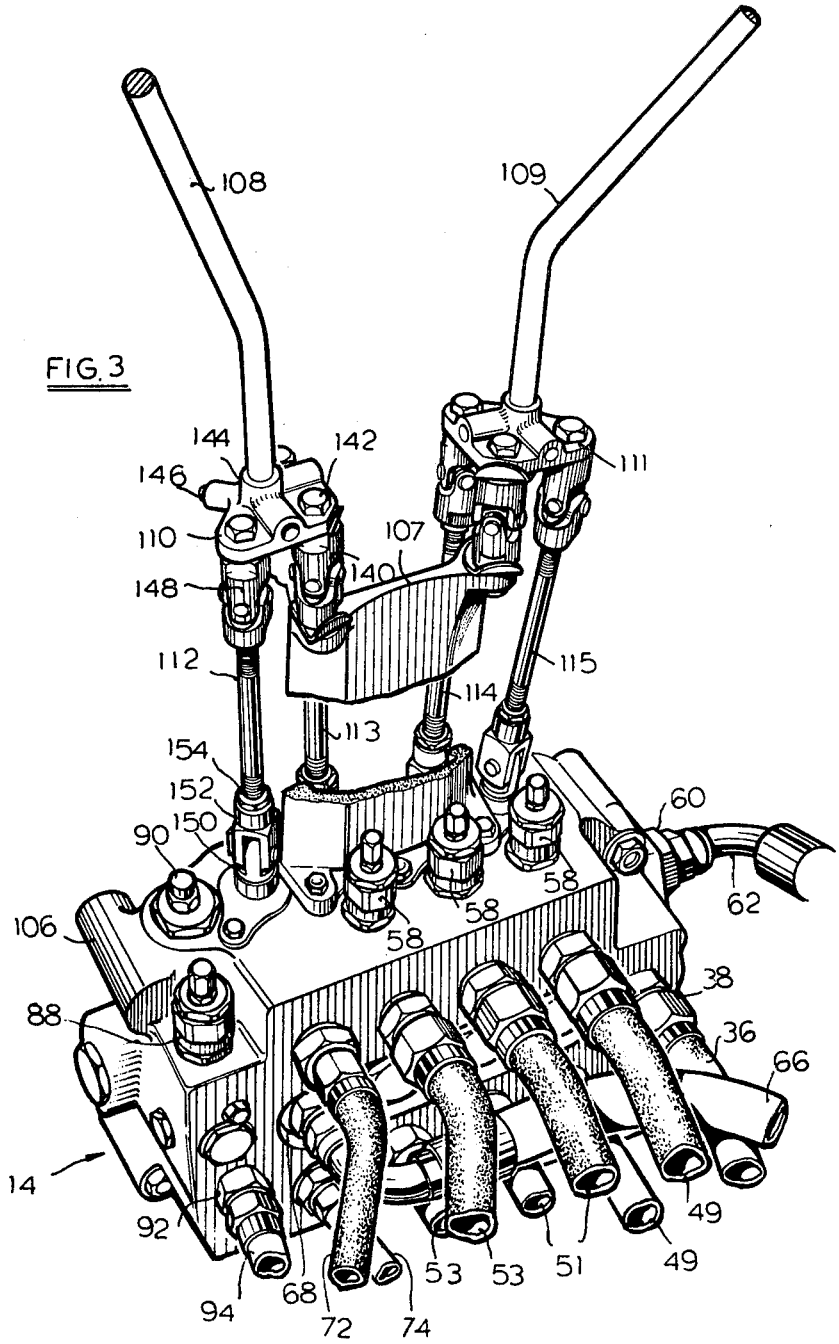
FIG. 3 is a perspective view of a hydraulic control valve assembly embodying the present invention and forming part of the hydraulic system shown in FIG. 2.

Referring now to FIG. 3, there is shown a perspective view of the assembly 14. The assembly 14 comprises a valve block 106 on which are mounted the valves 42, 44, 46 and 70. The valve assembly 14 also comprises a support pillar 107 on which is mounted a pair of operating levers 108, 109 and a mechanism comprising their associated brackets 110, 111 and control links 112 to 115. The operating levers 108, 109, the brackets 110 and 111, and the links 112 to 115 will be described in more detail hereinafter.

The valve block 106 together with the support pillar 107 comprise a base structure of the assembly 14.

The lines supplying and removing hydraulic fluid to the valve block 106 are denoted by the same reference numerals in FIG. 3 as in FIG. 2. The neutral circuit inlet 104 is not shown in FIG. 3 but is positioned on the opposite side of the valve block to the inlets and outlets for the lines supplying fluid to the various hydraulic motors.

The relief valves 58, 88 and the unloader 90 are also denoted by the same reference numerals in FIG. 3 as in FIG. 2 and as these are all of conventional design and do not form part of the present invention they will not be described in further detail.

Figure 4:
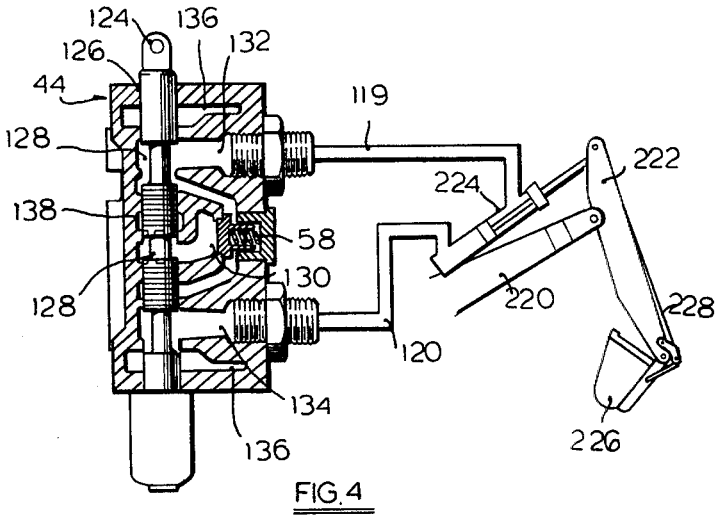
FIG. 4 is a sectional view of the valve of the hydraulic control valve assembly of FIG. 3 which controls the hydraulic motor of the excavating bucket of the excavator shown in FIG. 1.

The valves 42, 44 and 46 are conventional valves operated by valve spools and the valve 44 is shown in detail in FIG. 4 together with a simplified diagram showing how this valve is connected to the dipper motor 224.

The valves 44 comprises an operating member 124 in the form of a valve spool which is mounted for sliding movement in the valve bore 126. The valve spool 124 is formed with grooves 128.

The valve 44 further comprises a high pressure inlet chamber 130 which is connected to the main inlet 38 of the valve block 106, the one-way valve 58, outlet chambers 132 and 134 which are connected to lines 51 and exhaust ports 136. The chamber 130 is also connected to the neutral circuit outlet of the valve 46 and the valve 44 is also provided with a chamber 138 leading to the neutral circuit outlet of this valve which in turn is connected to the neutral circuit inlet of the valve 42.

With the valve spool 124 in the position shown in FIG. 4, high pressure fluid entering the chamber 130 will flow through the one-way valve 58, through the chamber 132 to the dipper motor and exhaust fluid from the motor 224 will flow through chamber 134 to the exhaust chamber 136, thereby closing this motor and raising the dipper arm 222. If the valve spool 124 is moved slightly upwards, as viewed in FIG. 4, the flow to both of the chambers 132 and 134 will be blocked and the high pressure fluid will pass out of the valve through the chamber 138. If the valve spool is now moved slightly higher, the high pressure chamber 130 will be connected to the chamber 134 whilst the chamber 132 will be connected to the exhaust chamber 136, thereby opening the dipper motor 224 and lowering the dipper arm 222.

The valves 42 and 46 are identical to the valve 44 whilst the valve 70 is generally similar except the grooves corresponding to grooves 128 are slightly wider so that the outlet ports which are connected to the lines 72 and 74 are connected to the exhaust chambers when the valve spool is in its central position.

Referring again to FIG. 3, the bracket 110 is secured to the support pillar 107 by a universal joint 140. The universal joint 140 is connected to the bracket 110 by a bolt 142. The operating lever 108 is mounted on the bracket 110 in a boss 144 and is secured in position by a screw 146. The link 112 is connected to the bracket 110 by a universal joint 148 and to the valve spool 150 of the valve 70 by a yoke 152. The link 112 is connected to the universal joint 148 and the yoke 150 by screw threads of opposite hand so that by rotating the link 112 the distance between the universal joint 148 and the yoke 152 may be varied and further rotation of the link 112 may be prevented by tightening the locking nuts 154.

The connections between the link 113 and the bracket 110 and the valve spool of the valve 46 are generally similar and also the general arrangement of the bracket 110 together with the operating lever 109 and the links 114, 115 is also similar to the arrangement of the bracket 110, the operating lever 108 and the links 112, 113.

Figure 5:
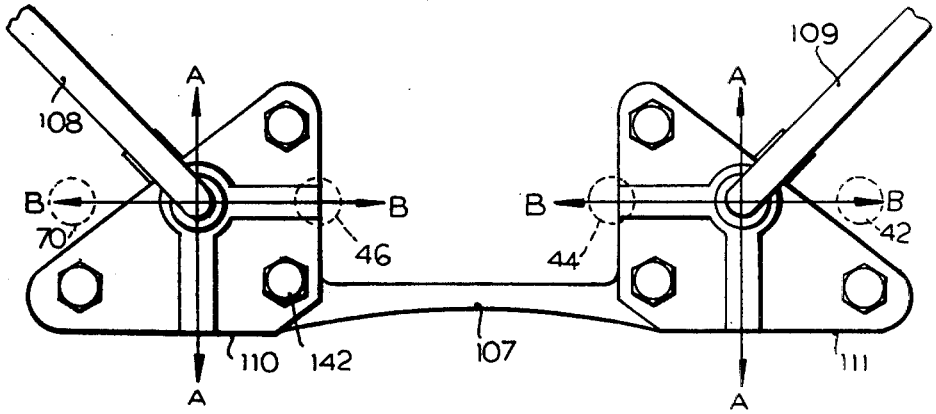
FIG. 5 is a plan view of the operating levers and their associated brackets of the hydraulic control valve assembly of FIG. 3 showing the assembly adapted for one mode of operation.

The position of the valves 42 to 46 and 70 relative to the brackets 110, 111 is shown in FIG. 5.

Figure 6:
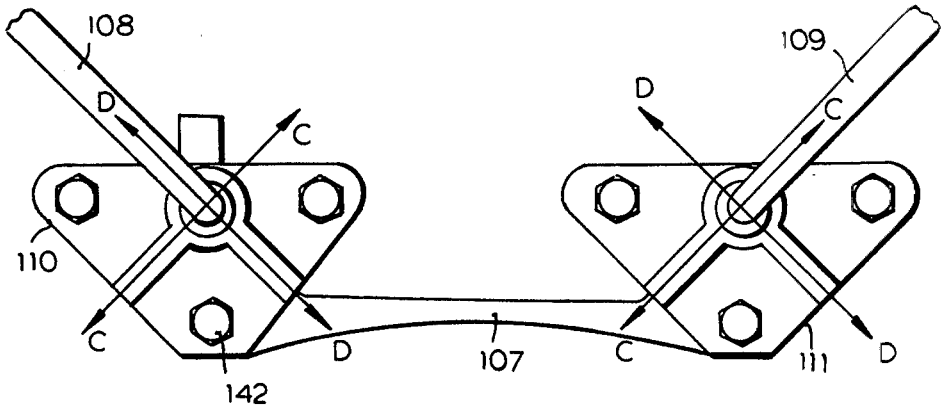
FIG. 6 is a similar view but showing the assembly adapted for another mode of operation.

The mode of operation of the control valve assembly 14 may be understood with reference to FIGS. 5 and 6. FIG. 5 is a plan view of the brackets 110, 111 together with the operating levers 108, 109 and the support member 107. As may be appreciated from this Figure, when the operating lever 108 is moved in a to-and-fro direction as indicated by the arrows A the link 113 will move vertically so as to operate the valve spool of the valve 46. If, on the other hand, the operating lever 108 is moved from side to side as indicated by the arrows B, the link 112 will move vertically so as to operate the valve spool 150 of the valve 70. Likewise, if the operating lever 109 is moved to-and-fro as indicated by the arrows A it will cause the link 114 to operate the valve 44 and if it is moved from side to side as indicated by the arrows B, it will cause the link 115 to operate the valve 42.

The arrangement shown in FIGS. 3 and 5 is suitable for use in countries where it is required that a control valve assembly is operated in a to-and-fro and side to side mode. However, in some countries it is required that a control valve assembly operates in a diagonal mode.

In order to achieve this alternative mode of operation it is only necessary to slacken the bolt 142 and the corresponding bolt on the bracket 111, rotate the brackets 110 and 111 to assume the position shown in FIG. 6 and at the same time adjust the length of the links 112 to 115 as necessary, and then re-tighten the bolt 142 and the corresponding bolt on the bracket 111. It may be noted that when the bracket 110, 111 are rotated the links 112 to 115 do not interfere with each other.

When the control valve assembly is arranged as shown in FIG. 6, movement of the control levers 108, 109 in a diagonal direction as indicated by the arrow C will operate the valves 42 and 46 and movement in diagonal directions as indicated by the arrows D will operate the valves 70 and 44.

Thus, the present invention provides a control valve assembly in which by means of a simple adjustment the mode of operation of the assembly may be changed.

Although the present invention has been described with reference to a control valve assembly which comprises four valves controlled by two operating levers, it is to be appreciated that the present invention could also be used in a control valve assembly which comprises any number of pairs of valves, each pair of valves being operated by a single operating lever.

Also, although the present invention has been described with reference to a hydraulic control valve assembly, it is to be appreciated that it could also be applied to a pneumatic control valve assembly.

I claim:

1. A fluid control valve assembly comprising:

a. a base structure, b. first and second control valves mounted on the base structure, c. a first operating member provided for the first valve, a second operating member provided for the second valve, movement of an operating member controlling flow of fluid through the associated valve, d. an operating lever, e. a first means supporting the lever for movement in a first direction and in a second direction, f. a second means supporting the first means relative to the base structure, g. a mechanism operatively connecting the operating lever to both operating members, movement of the operating lever in said first direction operating the first operating member movement of the operating lever in said second direction operating the second operating member, said second means permitting adjustment of the orientation of the first means relative to the base structure whereby said first and second directions are rotatable with respect to the base structure.

2. A control valve assembly according to claim 1 wherein the said mechanism comprises a bracket attached to the operating lever, the bracket being pivotally connected to the base structure at one position on the bracket, and the pivotal connection between the bracket and the base structure permitting rotation of the bracket relative to the base about two axes and selectively permitting or preventing rotation about a third axis, and two links having first and second ends, the first ends of the two links being connected to the bracket at positions spaced apart from each other and also spaced apart from said one position, and the second ends of the two links being operatively connected to the operating members of the valves.

3. A control valve assembly according to claim 2 wherein the connections between the bracket and the base structure and between the bracket and the links comprise universal joints.

4. A control valve assembly according to claim 2 wherein the connection between the bracket and the base structure includes a bolt, slackening or tightening of the bolt permitting or preventing rotation about the third axis.

5. A control valve assembly according to claim 2 wherein a line joining said one position with the position at which one of the links is connected to the bracket forms a right angle with a line joining said one position with the position at which the other of the links is connected to the bracket.

6. A control valve assembly according to claim 2 wherein the operating members comprise valve spools mounted for vertical sliding movement in their associated valves, the valves being positioned close together, and the bracket is positioned vertically above the valves.

7. A control valve assembly according to claim 1 wherein the assembly is a hydraulic control valve assembly.

8. A control valve assembly wherein two control valve assemblies as claimed in claim 1 are provided in a single base structure.

* * * * *